US005641002A

United States Patent [19]

Jirásko et al.

[11] Patent Number: 5,641,002

[45] Date of Patent: Jun. 24, 1997

[54] ANCILLARY AIR JET ARRANGEMENT IN THE REED WEFT CHANNEL OF AN AIR JET LOOM

[75] Inventors: Petr Jirásko; Zdeněk Volansky; Josef Dvořák; Zdeněk Koloc, all of Liberec, Czechoslovakia

[73] Assignee: Vyzkumy Ustav Textilnich Stroju Liberec A.S., Liberec, Czechoslovakia

[21] Appl. No.: 367,340

[22] PCT Filed: Sep. 7, 1993

[86] PCT No.: PCT/CZ93/00023

§ 371 Date: May 23, 1995

§ 102(e) Date: May 23, 1995

[87] PCT Pub. No.: WO94/05840

PCT Pub. Date: Mar. 17, 1994

[30] Foreign Application Priority Data

Sep. 9, 1992 [CS] Czechoslovakia ..... PV 2777-92

[51] Int. Cl.[6] ..... D03D 47/30

[52] U.S. Cl. ..... 139/435.5

[58] Field of Search ..... 139/435.5, 435.6, 139/192

[56] References Cited

U.S. PATENT DOCUMENTS

| | | | |
|---|---|---|---|
| 4,031,926 | 6/1977 | Zollinger et al. | 139/435.5 |
| 4,344,465 | 8/1982 | Husegawa et al. | 139/435.5 |
| 4,354,533 | 10/1982 | Suzuki et al. | 139/435.5 |

FOREIGN PATENT DOCUMENTS

| | | |
|---|---|---|
| 3204363 | 8/1983 | Germany . |
| 572117 | 1/1976 | Switzerland . |
| 1333948 | 10/1973 | United Kingdom . |
| 2060008 | 4/1981 | United Kingdom . |
| 2060720 | 5/1981 | United Kingdom . |

*Primary Examiner*—Andy Falik
*Attorney, Agent, or Firm*—Notaro & Michalos P.C.

[57] ABSTRACT

A method of insertion of the weft thread into the shed of an air-operated jet loom in which a main stream of air supplied to an end of a direct pick channel in a swinging loom reed is supplemented at regular length intervals along the whole length of the direct pick channel by ancillary air streams oriented obliquely in the direction of the weft thread insertion into an open side of the direct pick channel through which the air streams move the weft thread. A device for carrying out the above method of insertion of the weft thread into the shed of a loom has a loom reed adapted to swing on an axis and is equipped with a direct pick channel, with a main pick jet related thereto on one lateral side, and with a plurality of ancillary jets situated at uniform intervals along its length and each ancillary jet having an outlet apertures oriented obliquely into the open side of the pick channel of the loom reed.

9 Claims, 8 Drawing Sheets

ANCILLARY AIR JET ARRANGEMENT IN THE REED WEFT CHANNEL OF AN AIR JET LOOM

BACKGROUND OF THE INVENTION

The known methods of weft thread insertion into the shed of an air-operated jet loom, as disclosed, e.g., in U.S. Pat. No. 3,911,968 or GB 1,333,948 use a profile swinging loom reed with a direct pick channel, and a pneumatic system consisting of a main pick jet and a series of geometrically arranged ancillary jets for controlling the weft thread during the weaving process. The improvement of the efficiency of the ancillary jets is directed in particular to increase the reliability of the pick of the weft thread thrown into the shed of the warp threads, to reduce the consumption of air and, as the case may be, of electric power as well, and to increase the pick speed of the weft thread. In general terms, the dominant aim is to achieve a top-quality weft thread pick, this quality being under the existing circumstances a fundamental criterion having a decisive influence both on the economy and on the quality of the weaving process.

The known device for inserting the weft thread into the shed of an air-operated loom, schematically shown in FIG. 1, contains a profile loom reed P in which there is provided, approximately in the middle between the upper and the lower weave of the system of flat profile reed dents PT, free space for the weft thread pick, referred to as pick channel K. The open side of the pick channel K is situated in the direction of the tangent to the periodical swinging movement of the batten B in which the loom reed P is fixed. During the forward movement of the loom reed P towards the cloth, the rear closed side of the pick channel K carries the weft thread, and in the tangent direction of the movement of the batten B beats-up the weft thread to the cloth face.

The action of the pneumatic system of the loom creates a stream of the carrying medium imparting its motion energy to the weft thread being picked in the pick channel of the profile loom reed. This imparting action takes place only in a definite interval of the operation cycle of the loom when the area of the pick channel is not covered with warp threads or, in other words, when the shed is open. This time interval is often referred to as picking angle, if its magnitude is expressed in grades indicating the amount of turning motion of the main shaft of the loom. The performance of the loom is then directly proportionate to the magnitude of the picking angle and to the speed of the weft thread picking.

The speed of the weft thread picking depends on the quality of the speed field of the carrying substance, e.g. of air, in the pick channel K, produced by the ancillary jets T, situated at a predetermined interval along the loom reed P in the direction of the loom width. The quality of the speed field of the carrying substance is influenced by the concrete form of the ancillary jet T, outlet coefficient (factor) dispersion, etc., and also by the location of the outlet aperture V of the ancillary jet T, i.e., by the position of the axis OV of the outlet aperture, corresponding to the axis of the stream of the carrying substance streaming out, with respect to the axis OK of the pick channel K of the loom reed P. Under these conditions, the ancillary jets T are seated under the shed axis and are fixed to the batten B of the loom in such a manner that during the periodical swinging movement of the loom reed P carrying batten B they do not prevent the picked weft thread from being beaten-up to the cloth face and bound by the warp threads.

To further define the influence of this arrangement of the air-operated jet looms with profile loom reeds used, the following facts about the action of the carrying substance, e.g., of an air stream, on the weft thread under the pick conditions are provided.

The relations describing the action of the air stream on the weft thread immersed in, and surrounded by, the air stream, lead to the conclusion that the magnitude of the resultant of the vector sum of the outer forces acting in a certain direction on a length element of the weft thread is a function of the flow momentum. The latter being the difference between the momentum of the carrying substance leaving the surface area of the weft thread surrounded by it, and the momentum of the carrying substance entering into contact with the surface area of the weft thread.

The outer forces are: the pressure force, uniform in the whole surrounding area and therefore producing a zero effect; the flow momentum introduced from the outside under the action of the loom pneumatic system exerted on the weft thread surrounded by the air flow, in connection with the force of gravity acting on the weft thread; and the force of gravity acting on the carrying substance, which is so small as to be negligible.

In the real pick, the action of the air stream is a very complicated phenomenon because the air stream is neither constant in time nor laminar. Due to this, the position of, above all, the weft thread point carried by the air stream in the pick channel is not constant; further, in the pick interval, the loom reed moves together with the loom batten.

In the known ancillary jets T used in air operated jet looms equipped with a direct pick channel K in the profile loom reed P, the axes OV of the outlet apertures V of the ancillary jets T form an angle with the axes OP, the latter being perpendicular to the longitudinal axis of the ancillary jet T passing through the center of the outlet aperture V. This parameter, intrinsic to every ancillary jet T, is referred to as the elevation angle e. By turning the ancillary jet T about its longitudinal axis, the angle e between the air stream and the loom reed P can be modified. The adjustment in height of the position of the outlet aperture of the ancillary jet T in the direction of its longitudinal axis is carried out with reference to the contour of the pick channel K of the loom reed P.

To sum up briefly, the air stream flowing out of the outlet aperture V of the ancillary jet T acts in a direction forming a space angle $\mu$ with the axis OK of the pick channel K of the profile loom reed P. The force of the air stream acting in this direction can be resolved into components arranged in three-dimensional orthogonal coordinate system in which one component acts in the weft thread axis whose direction is, in the currently used version of pneumatic looms, broadly identical with the axis OK of the pick channel K in the profile loom reed P. A second component acts not in the weft thread axis, but instead, tends to push the weft thread to the dents PT in the rear section of the pick channel K of the profile loom reed P. This component is summarily counteracted by a reaction force trying to push the weft thread farther from the reed dents PT. This reaction force is generated, for instance, by the air stream between the dents PT of the loom reed P due to the motion of the loom reed P or by the action of the air particles of the carrying substance when rebounding from the dents PT of the loom reed P, etc. A third component, here acting vertically, depends on the magnitude of the above mentioned elevation angle e of the outlet aperture V of the ancillary jet T. This component is counteracted by the gravitational force due to the weft thread mass, and by the reaction force due to the stream particles of the carrying substance rebounding from the upper nose-like lug of the profile dents PT constituting the pick channel K of the loom reed P.

It is a general aim in the design of such machines to place the ancillary jet T with respect to the pick channel K so as to ensure that the force component acting in the weft thread axis is maximal, while the nose-like lugs that are a part of the profile of the pick channel K adversely affect the formation of the speed field inside the pick channel K.

The drawbacks of the currently used arrangement in an air-operated jet loom with profile loom reed, with an approximately horizontal plane of the shed axis, with the beat-up perpendicular to the shed axis plane, and with ancillary jets mounted below the shed axis, are due to the fact that the air stream coming from the ancillary jet enters the pick channel at a space angle and acts fully in the upper part of the pick channel while its action in the lower part of the pick channel is less intense. The differentiation of the speed field in cross section is due to the difference of intensity of the action of the picking substance in the upper and the lower part of the channel.

Partly due to the force of gravity, the weft thread tends to move during the pick to the lower part of the pick channel where the carrying substance moves at reduced speed. This can reduce the instantaneous as well as the average pick speed of the weft thread and consequently, the loom performance. In the most disadvantageous case, the weft thread can even get out of the pick channel, with ensuing defects in the weaving process, because a section of the weft thread is at a given time interval not exposed to the action of the carrying substance and is woven-in as a loop.

The uneven composition of the speed field along the axis of the pick channel, representing a non-stationary speed field generated by the carrying substance in the pick channel of the loom reed, is characterized also by the values of the stream speed of the carrying substance along the axis of the pick channel. But these values are exposed to heavy fluctuations in function of the value of the length coordinate. Maximum values are reached (in the stream speed) at the entry spot of the free stream of the carrying pressure substance from the ancillary jet into the pick channel area. With the increasing value of the length coordinate, the speed in the direction of the channel axis decreases up to the section where the speed field is acted upon by the carrying substance from the next ancillary jet. The front part, or the point, of the weft thread that is the part which most needs to receive kinetic energy, moves during the pick through such sections of the pick channel where the speed of the carrying substance is mutually different. Due to this, the weft thread is not ideally stretched during the pick and, again in the most unfavorable case, is apt to create loops due to the fluctuating tensile strength. In the currently used arrangement of the ancillary jets and of the pick channel, the speed fluctuation in the direction of the longitudinal axis of the channel is due to a compromise made in choosing the elevation angle of the ancillary jet, the size of the outlet aperture of the ancillary jet, and the distance between the ancillary jets. The direction of the carrying substance stream being determined by the designated position of the ancillary jet on the batten of a loom, and possible changes increasing either the distance between the ancillary jets or the size of the outlet apertures cannot be successfully applied without prohibitive increase in the energy consumption. Other means intended to reduce the differences of the speed field composition along the axis of the pick channel, such as an ancillary jet fitted with a plurality of outlet apertures whose axes form an angle different from zero, geometrically defined, are not applicable. Thus, it can be stated that in the case of a single outlet aperture in the ancillary jet or in case of a plurality of outlet apertures with parallel axes, the carrying substance acts on the weft thread in the section between two ancillary threads locally, because in the known arrangement of the ancillary jets with respect to the pick channel the stream of the carrying substance cannot be determined otherwise than in the described manner.

An attempt to eliminate at least a part of the above described drawbacks is disclosed, for instance, in GB 2 060720, aiming at evening out the air stream along the length of the pick channel of the loom reed. To achieve this, at least some of the ancillary jets are mounted rotatably on their axes. Depending on their angular position there is created a more or less oblique component of the air stream carrying the weft thread.

Neither this solution, nor the other known ones have succeeded in eliminating the basic drawbacks due to the fact that the air stream from the ancillary Set enters the pick channel under a given space angle and the uneven distribution of the speed field in the cross section of the pick channel of the loom reed.

Another drawback consists in the fact that the existing devices for entering the weft thread into the shed on an air-operated jet loom with a profile reed have comparatively high moment of inertia, approximately equal to the sum of the product of their masses with the squares of distance of their centers of gravity from the axis of the swinging motion of the batten. Since the magnitude of the force effects acting on the batten of a loom is the product of the moment of inertia and of the angular acceleration, it is as a rule necessary, for keeping them under control, to make a compromise to the detriment of the pick angle value, thus reducing the machine performance.

The invention aims to eliminate many of the drawbacks of the known method of inserting the weft thread into the shed of air-operated jet looms with a direct pick channel in the loom reed and to create a device for carrying out the method intended to permit an increase in the function parameters of a loom.

SUMMARY OF THE INVENTION

The above mentioned aim is reached by a method of inserting of the weft thread into the shed of an air-operated jet loom in which the main air stream supplied to the beginning of the direct pick channel in the swinging loom reed is supplemented at regular length intervals along the whole length of the direct pick channel by ancillary air streams oriented obliquely into the open side of the direct pick channel so as to carry the weft thread, according to this invention under the principle that the ancillary air streams comprise a vertical component acting in the direction of the force of gravity, thus stabilizing the effect of the air stream on the weft thread due to the fact that the weft thread is fed exclusively near the bottom of the pick channel of the loom reed.

In a preferred embodiment, the ancillary air streams are divided into at least two separate air streams acting on the weft thread in the length section between two neighboring ancillary air streams in the direction of the weft thread pick separately thus rendering the air stream in this direction more uniform (air stream carrying the weft thread).

Advantageously, the separate ancillary air streams differ from each other in flow rate, this rate being larger at the second ancillary stream, directed a greater distance away. The direct pick channel, in the method according to the present invention, can at least in a time interval of the weft thread pick move with respect to the outlet places of the ancillary air streams.

The device for carrying out the method of insertion of the weft thread into the shed according to this invention comprises a loom reed swinging on a swinging axis and fitted with a direct pick channel having on one lateral side related thereto a main pick jet, and having a plurality of ancillary jets disposed at regular intervals along its length whose outlet apertures are oriented obliquely into the open side of the direct pick channel. The principle of the device consists in that the plane passing through any outlet aperture of any ancillary jet and through the swinging axis passes during the weft thread pick through the open side of the direct pick channel of the loom reed.

The ancillary jets of the device can be fitted with at least two outlet apertures each, and whose elevation angles differ from each other. Advantageously, the cross sections of an ancillary jet also differ from each other.

The best results can be obtained if the outlet apertures of an ancillary jet with a smaller elevation angle of their axis have a larger cross section than the outlet apertures with a larger elevation angle.

The principle of the device according to this invention consists also in that the direct pick channel of the loom reed is open in the direction of the normal line of the motion of the loom reed around the swinging axis.

This device for carrying out the method achieves an advantageous filling of the space of the direct pick channel of the loom reed with the stream of the carrying substance from the ancillary jet so that the speed field in cross section of the direct pick channel, in the case when the axis of the flow paths of the carrying substance from the outlet apertures is directed to the middle of the open side of the direct pick channel, is symmetrically distributed along the axis of the open side of the profile of the direct pick channel.

The speed field generated according to the invention along the axis of the pick channel reduces the fluctuations of the tensile stress in the weft thread.

Another advantage of the device according to this invention consists in a considerable reduction of the moment of inertia of the batten permitting better control of the force effects acting on the beat-up mechanism of the loom. Together with the increased pick speed, improvement in conditions for transmitting the momentum from the carrying substance to the weft thread in the pick channel of the loom reed, and the increase in the pick angle, this contributes to increased loom performance.

Figure 1:
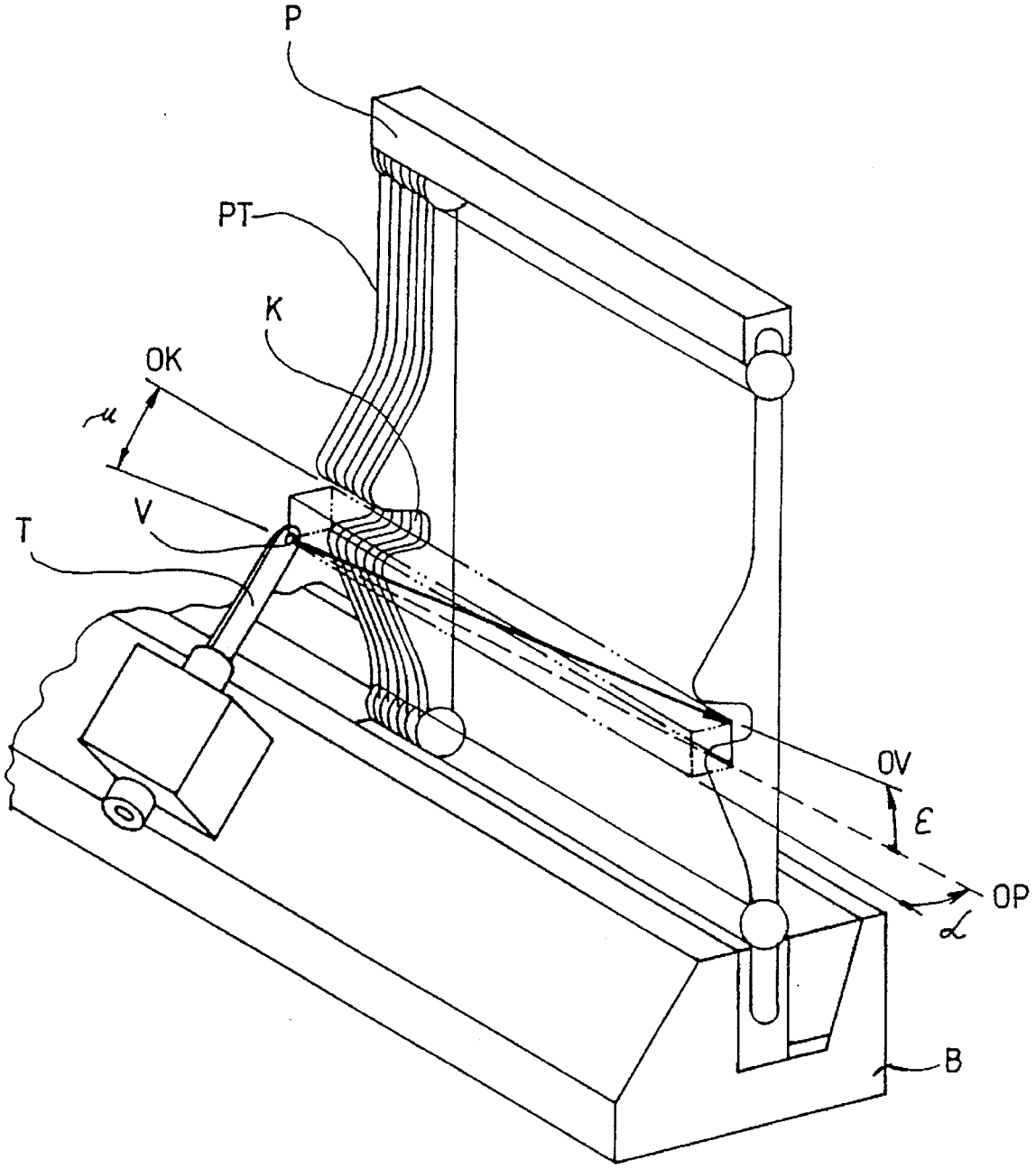
Fig. 1 (PRIOR ART)
FIG. 1 is a schematic drawing of a known method of the weft thread, as has been used in air-operated looms with profile reeds. This state of the art has been described in the previous part of this specification.
Figure 2:
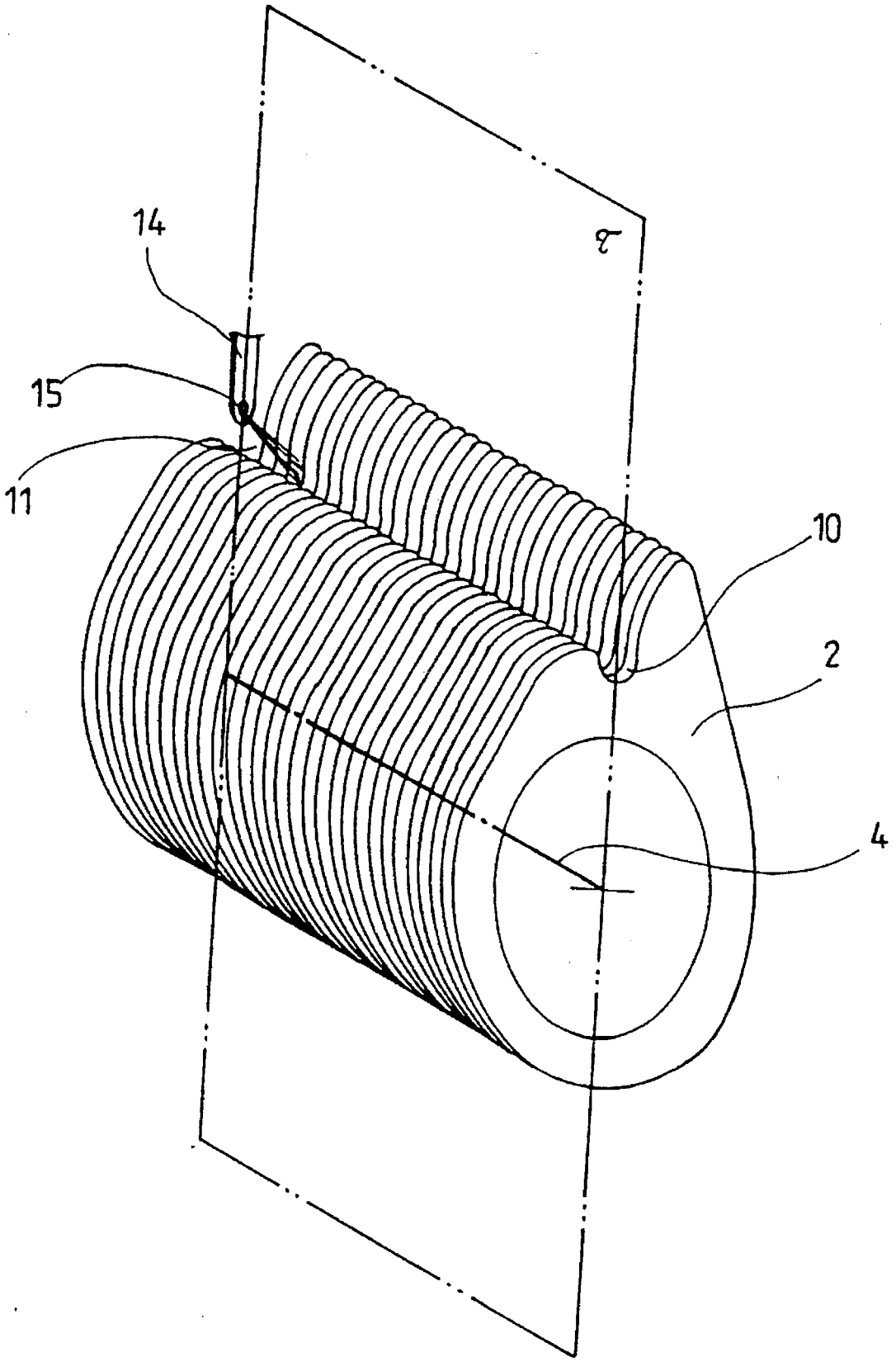
Figure 4:
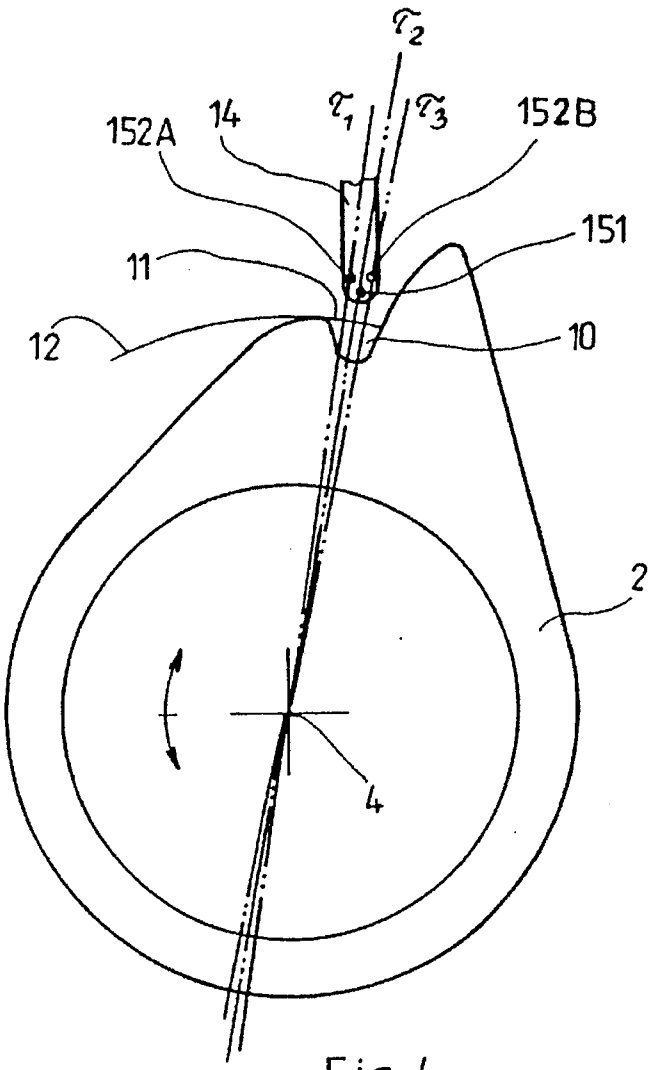
Figure 3:
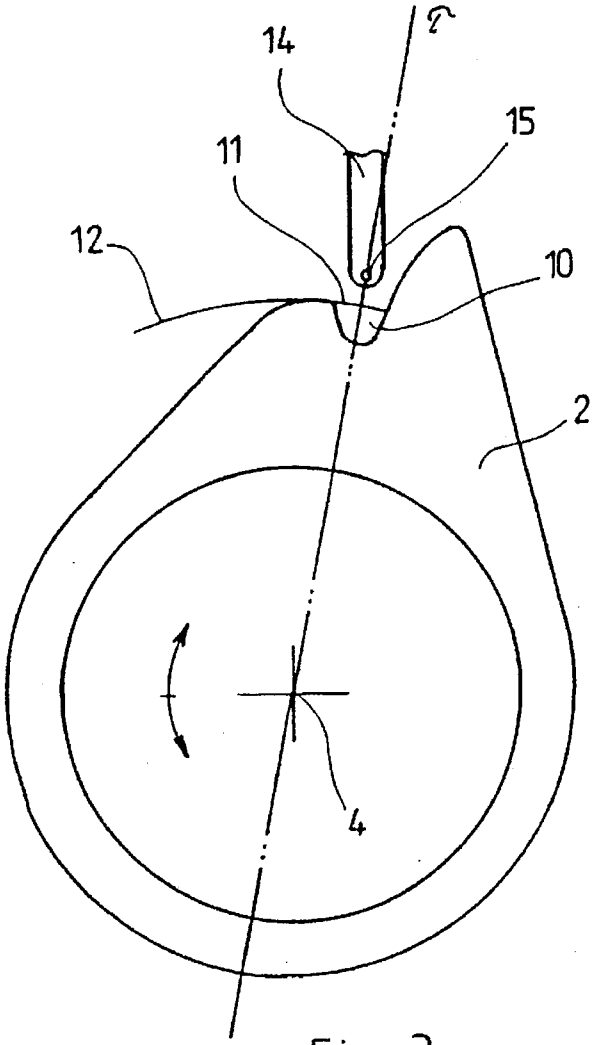
Figure 5:
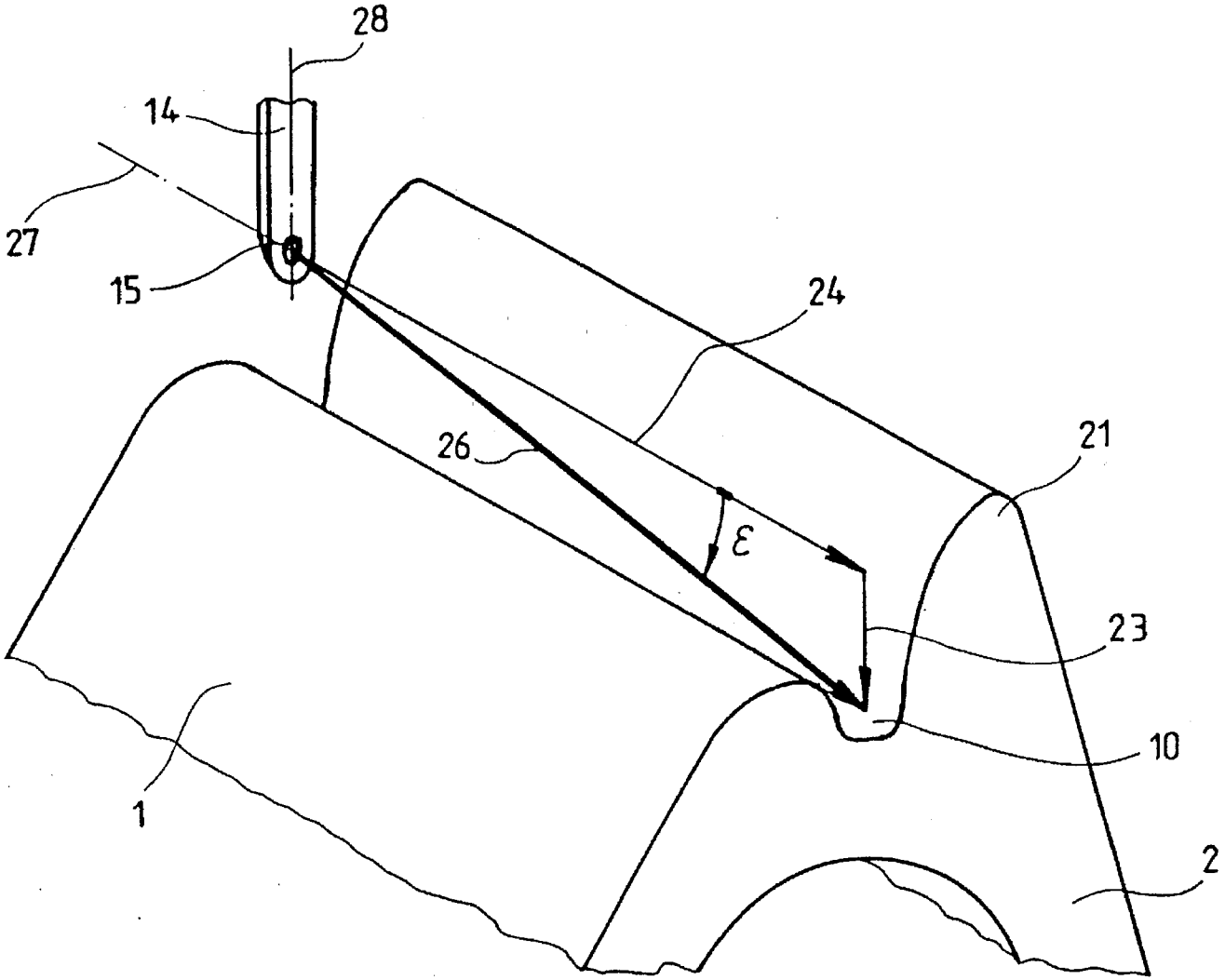
Figure 6:
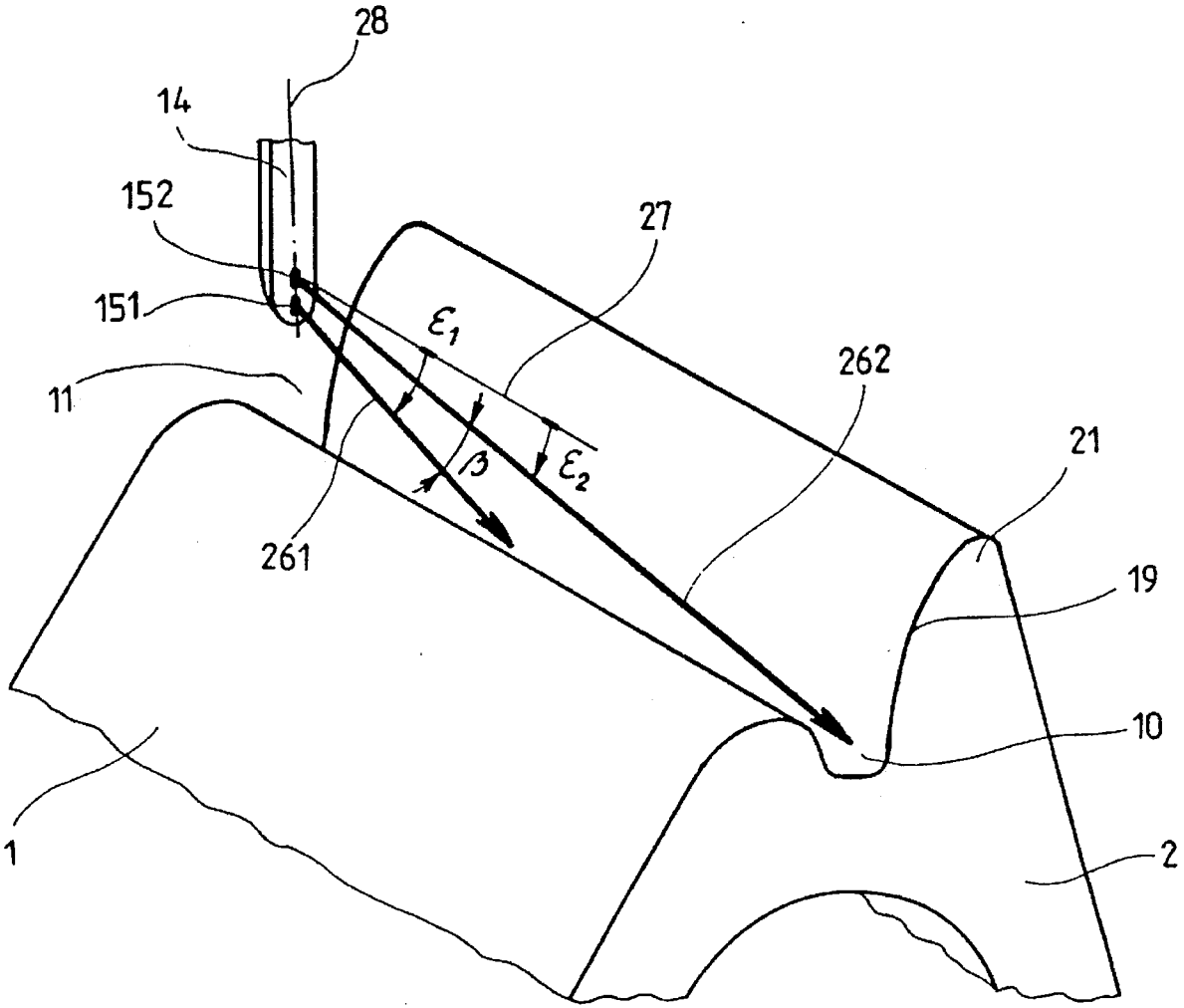
Figure 7:
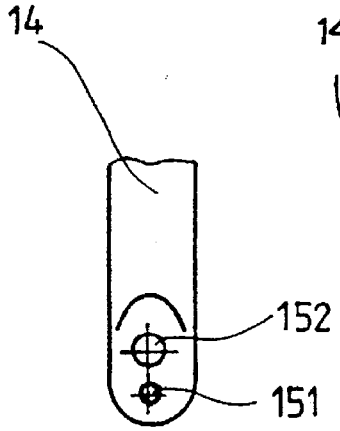
Figure 8:
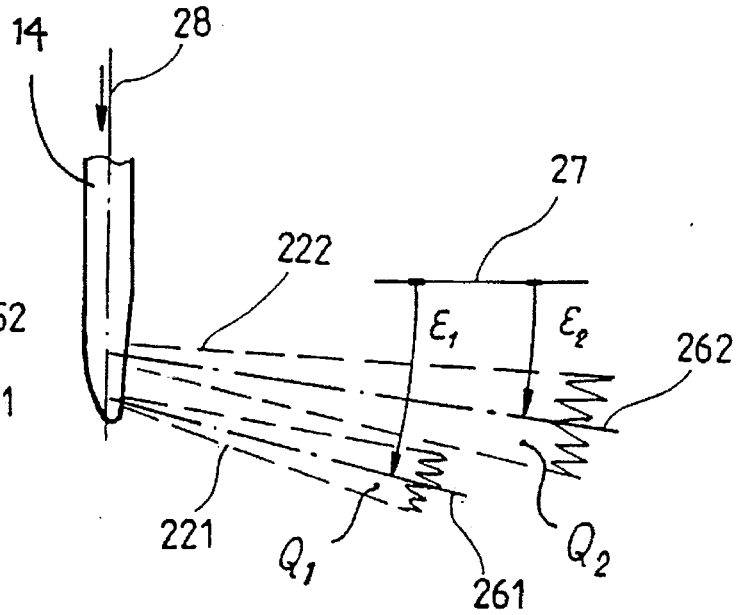
Figure 9:
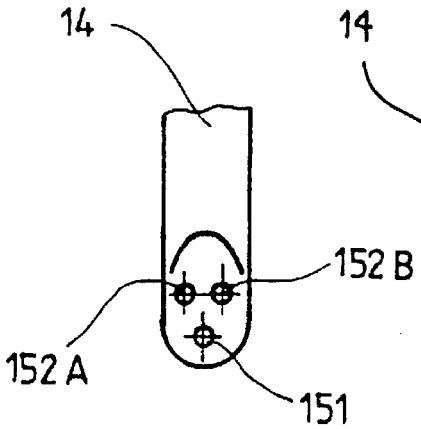
Figure 10:
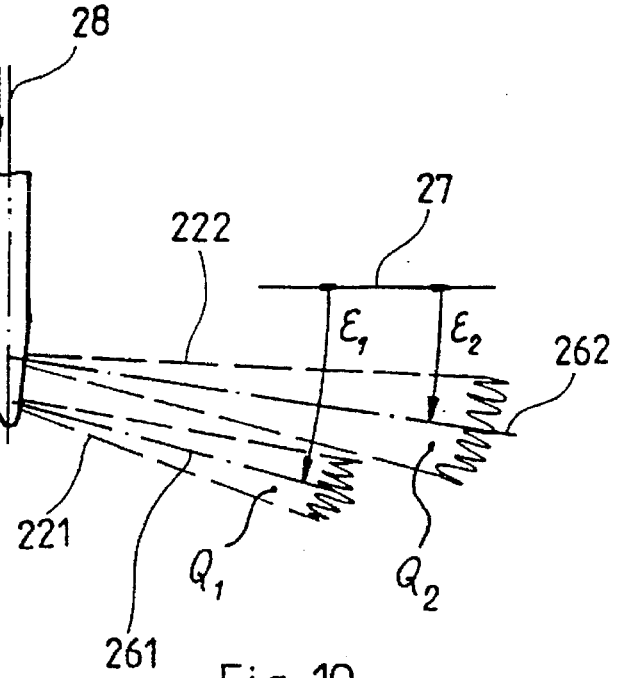
Figure 11:
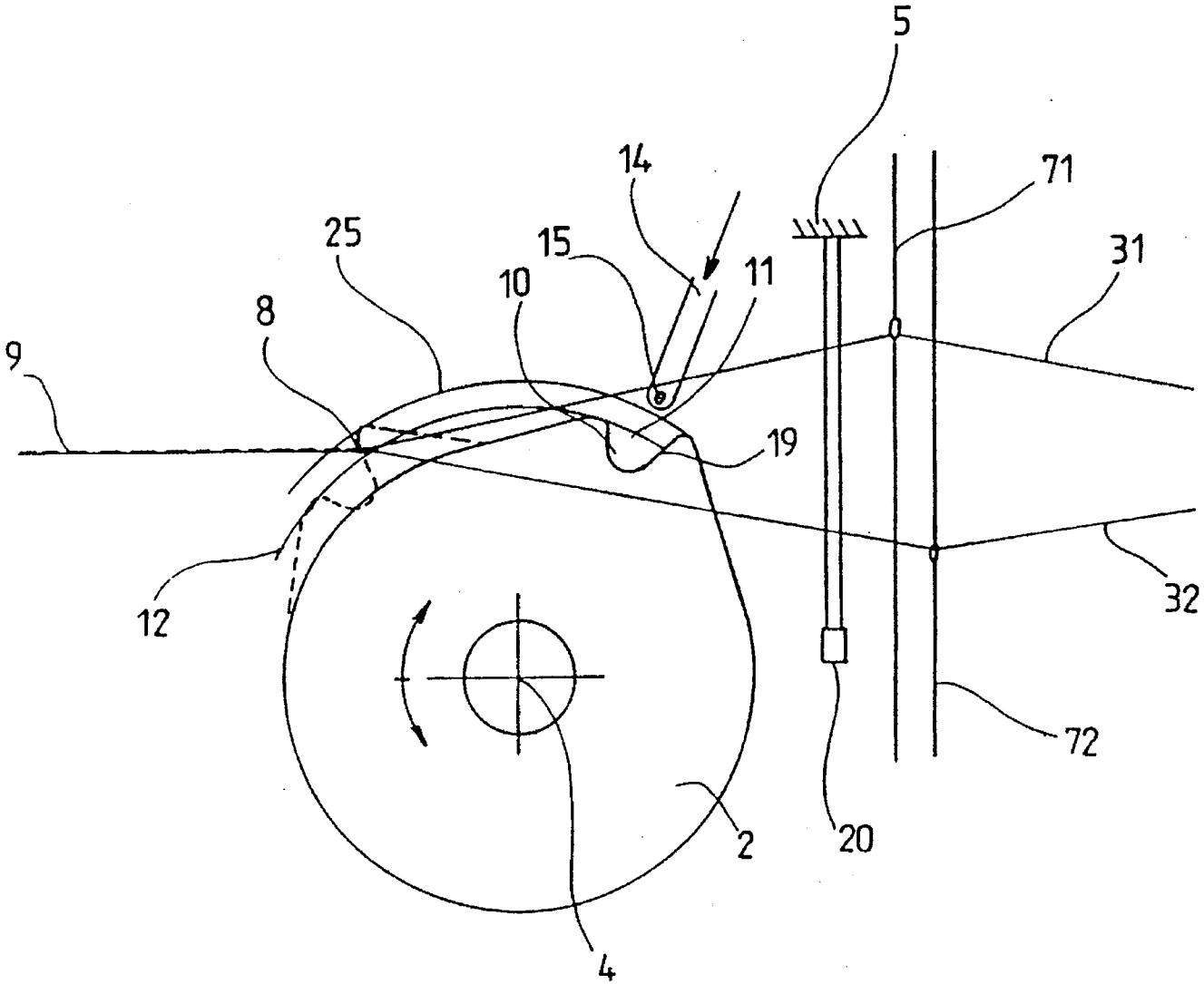
Figure 12:
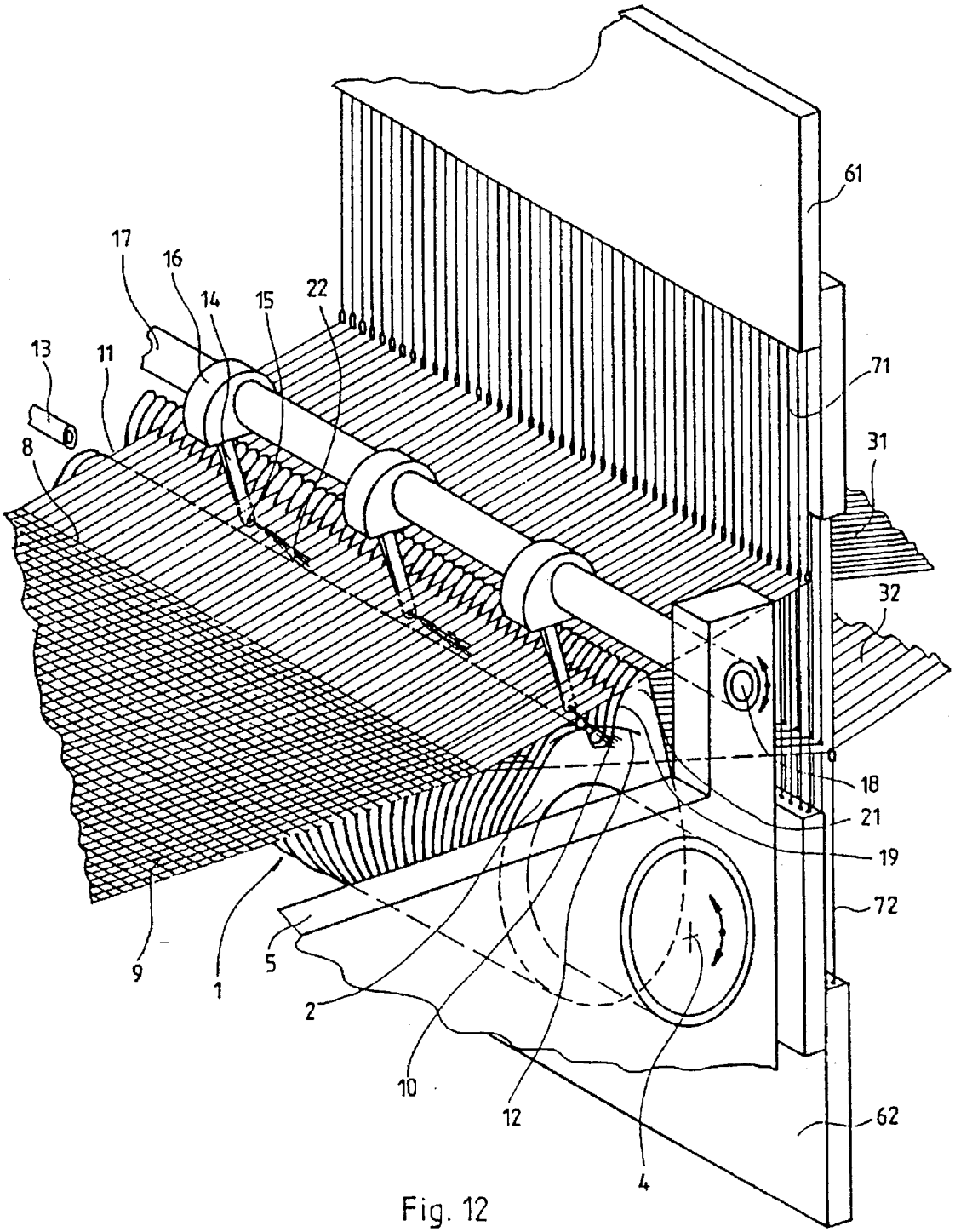

The examples of embodiment of the device for carrying out the method according to this invention are schematically shown in the following Figures where:

FIG. 2 is an axonometric view of a part of the loom reed showing also the position of an ancillary jet with respect to the direct pick channel;

FIG. 3 is a side-view of the loom red showing also the position of an ancillary jet with one outlet aperture;

FIG. 4 is a side-view of the loom reed showing also the position of an ancillary jet with a plurality of outlet apertures;

FIG. 5 is an axonometric view of a schematically shown direct pick channel of the loom reed, showing also the outlet direction of the carrying substance from an ancillary jet with one outlet aperture;

FIG. 6 is an axonometric view of a schematically shown direct pick channel of the loom reed showing also the outlet direction of the carrying substance from an ancillary jet with two outlet apertures FIG. 7 is a view of the outlet part of an ancillary jet with two outlet apertures;

FIG. 8 is a side-view of the ancillary jet shown in FIG. 7;

FIG. 9 is a view of the outlet part of an ancillary jet with three outlet apertures;

FIG. 10 is a side-view of the ancillary jet shown in FIG. 9;

FIG. 11 is a side-view of an arrangement of a device with a stationary reed; and FIG. 12 is an axonometric view of an alternative embodiment of the device with a loom reed whose beat-up edge protrudes above the upper warp threads of the open shed.

DESCRIPTION OF THE PREFERRED EMBODIMENT OF THE INVENTION

A loom reed 1 of an air-operated jet loom comprises gliders 2, interconnected in a known manner so as to leave slots between the gliders 2 of the loom reed 1 for the passage of the upper warp threads 31 and the lower warp threads 32. The loom reed 1 is mounted for reversible rotation around an axis of swinging 4 provided in the frame 5 of the loom and is coupled with a not represented known mechanism from which it receives its swinging motion.

The warp threads 31, 32 are threaded from a not shown warp beam in a known manner to at least two healdframes 61, 62; as is schematically shown in FIGS. 11 and 12. The warp threads 31, 32 are in a known manner threaded into healds 71, 72 which are a part of the healdframes 61, 62. The healdframes 61, 62 are coupled with a lifting device (not shown) producing their periodical up and down movement, thus periodically creating from the warp threads 31, 32 a shed on whose end is the last woven-in weft representing the face 8 of cloth 9.

The gliders 2 of the loom reed 1 have a recess forming a direct pick channel 10 for inserting a weft (not shown) into the shed by means of air stream. The open side 11 of the pick channel 10 on an imaginary circle 12 of the open side of the pick channel is oriented in the direction of the normal line of the reversible rotary movement of the loom reed 1.

The pick channel 10 of the loom reed 1 and the known main pick jet 13 are oriented with respect to each other in a known manner, as is schematically shown in FIG. 12. In the pick position of the loom reed 1, situated over the open side 11 of the pick channel 10, known ancillary jets 14 are spaced apart regularly along the pick channel 10 and connected to a pressure air source (not shown). The outlet apertures 15 of the ancillary jets 14 are provided about the middle of the open side 11 of the pick channel 10 of the loom reed 1.

The ancillary jets 14 can be fixed to the loom frame 5 or, alternatively, to a mechanism adapted to impart a sliding, swinging or, as the case may be, another movement to the jets 14. In the embodiment shown in FIG. 12, the ancillary jets 14 are situated in holders 16 fixed to a hollow shaft 17 rotatably mounted in the loom frame 5 and coupled with a known device (not shown) from which it receives its reversible rotary movement synchronized with the movement of the loom reed 1 and the other loom mechanisms.

The cavity 18 in the hollow shaft 17 is in this embodiment connected in a known manner to a pressure air source. From the cavity 18 of the hollow shaft 17, the pressure air is transmitted in a known way into the ancillary jets 14.

However, pressure air can be supplied to the ancillary jets 14 in other ways as well.

In the embodiment shown in FIG. 11, the beat-up edge 19 of the gliders 2 of the loom reed 1 is in the shed position situated under the upper warp threads 31. For this reason, a stationary loom reed 20 is mounted between the loom reed 1 and the healds 71,72. Loom reed 20 is fixed to the loom frame 5 and used to separate the warp threads 31 and 32, especially the upper warp threads 31 in the time interval when the beat-up edge 19 of the loom reed 1 is situated below the level of the upper warp threads 31.

In the embodiment shown in FIG. 12, parts of the gliders 2 are elongated and shaped as a finger 21 whose apex is aligned also in the pick position of the loom reed 1 above the level of the upper warp threads 31. In such a case, the use of the stationary loom reed 20 appears to be superfluous, because the warp threads 31, 32 are situated between the gliders 2 of the loom reed 1 throughout the operation cycle of the loom and are separated by the gliders 2.

The embodiment of the device for carrying out the method of insertion of the weft thread into the shed according to the invention, as shown in FIG. 12, works as follows:

At the beginning of the operation cycle, the lifting device makes the healdframes 61, 62 move in opposite directions, thus opening the upper and lower warp threads 31, 32 threaded in the healds 71, 72, and creating the shed. At the same time, the loom reed 1 together with the other cooperating mechanisms moves to the pick position in which the loom is ready to throw the weft into the open shed. Then, the action of the main pick jet 13 begins, so that the pressure substance throws the weft thread into the pick channel 10 of the shed, and the ancillary jets 14, are subsequently activated in a known manner in cooperation with the main jet 13. The ancillary air streams 22 of the air coming from the ancillary jets 14 enter the pick channel 10, and the outlet apertures 15 of the ancillary jets 14 are directed at the time of the weft pick approximately to the middle of the open side 11 of the pick channel 10 of the loom reed 1.

When the weft thread pick is finished, the air supply to the ancillary jets 14 is stopped and the loom reed 1 swings to the beat-up position; at this interval, the beat-up edges 19 of its gliders 2 move in the direction of the face 8 of the cloth 9 and carry the weft thread. Simultaneously, the hollow shaft 17, whose motion is shared by the ancillary jets 14, turns, moving back before the fingers 21 of the gliders 2 of the moving loom reed 1 and so as to get out of the shed. The healdframes 61, 62 move, and the weft thread is closed in the pick channel 10 by the warp threads 31, 32. As the beat-up position of the loom reed 1 is reached, the weft thread is beaten-up to the face 8 of the cloth 9 by the beat-up edges 19 of the gliders 2 of the loom reed 1. The healdframes 61, 62 continue then their motion so that the warp threads 31, 32 form a weave behind the beaten-up weft thread and open into the following shed. The loom reed 1 and the other mechanisms returns to its pick position.

The function of the embodiment shown in FIG. 11 is the same, but the ancillary jets 14 can be stationary, because the path of the apex of the gliders 2 of the loom reed 1, represented as an imaginary circle 25 of the apex of the gliders 2, lies below the lower end of the ancillary jets 14. This embodiment uses the stationary loom reed 20 for separating the warp threads 31, 32.

The pick position of the loom reed 1 and of the ancillary jet 14 is shown in FIGS. 2 to 6. As shown in FIGS. 2 and 3, the plane e, passing through the axis 4 of swinging of the loom reed 1 and through the outlet aperture 15 of the ancillary jet 14, passes in the pick position also through the open side 11 of the pick channel 10 of the loom reed 1.

The term "open side 11 of the pick channel 10" is intended to designate that part of it which would imaginarily close its profile by a cylindrical surface with maximal diameter, the axis of the cylindrical surface being identical with the axis 4 of swinging of the loom reed 1, which is shown in FIG. 3 in the side-view as the imaginary circle 12 of the open side 11 of the pick channel 10.

As is shown in FIG. 5, the weft thread, while being picked through the pick channel 10 of the loom reed 1, is acted upon by the ancillary air stream 22 directed from the ancillary jet 14 in the direction of the weft pick obliquely into the open side 11 of the pick channel 10; thus the vector of action of the ancillary stream 22 along the axis 26 of the outlet aperture 15 is a two-dimensional one, and the resolution of forces in orthogonal coordinates evidences the vertical component 23 of the force of the ancillary stream 22 of air acting on the weft thread in the same direction as the force of gravity.

The magnitude of the vertical component 23 of the force of the ancillary stream 22 depends on the parameter of the ancillary jet 14 referred to as elevation angle e, i.e., the angle between the axis 26 of the outlet aperture 15 of the ancillary jet 14 and the normal line 27 to the longitudinal axis 28 of the ancillary jet 14. The ancillary streams 22 of air coming from the ancillary jets 14 act upon the weft thread with the vertical component 23 of the force which in addition to the gravitational force due to the mass of the weft thread pushes the weft thread to the bottom of the pick channel 10 of the loom reed 1 and prevents the weft thread from leaving the pick channel 10. In the weft thread pick direction, the longitudinal component 24 of the force of the ancillary air stream 22 coming from the ancillary jet 14 acts to move the weft thread forward.

In the example of embodiment shown in FIG. 4, the mouth of the ancillary jet 14 is fitted with a plurality of outlet apertures 151, 152A, 152B, so arranged that each of the planes e1, e2, e3, passing through the axis 4 of swinging of the loom reed 1 and any outlet aperture 151, 152A, 152B of the ancillary jet 14 passes in the pick phase of the weft thread through the open side 11 of the pick channel 10 of the loom reed 1.

In the example of embodiment shown in FIG. 6, there is a modification intended to reduce the differences existing in the distribution of the speed field in the direction of the weft thread pick through the pick channel 10 of the loom reed 1, and consisting in that the ancillary jet 14 has two outlet apertures 151, 152 whose axis 261, 262 make a geometrically defined angle β so that the ancillary jet 14 is characterized by more than one elevation angle e1, e2. The ancillary air streams 22 coming from the outlet apertures 151, 152 of such an ancillary jet 14 are more effective in filling the related length section of the direct pick channel 10 of the loom reed 1 with the carrying substance.

In a preferred version of the embodiment, the second separated ancillary air stream 222 from the second outlet aperture 152 of the ancillary jet 14, whose axis 262 makes the smaller elevation angle e2 and is therefore directed to the more distant part of the related length section of the pick channel 10, has a flow-rate Q2 superior to that of the first separated ancillary air stream 221 from the first outlet aperture 151 of the ancillary jet 14 whose axis 261 makes the greater elevation angle e1 (flow-rate Q1). In this way, a very uniform distribution of the speed field of the carrying substance in the direction of the weft thread pick through the pick channel 10 of the loom reed 1 is achieved.

In the embodiment shown in FIGS. 7 and 8, the increase in flowrate Q2 of the second separated air stream 222 directed to the more distant part of the related length section of the pick channel 10 of the loom reed 1 is achieved by increasing the cross section of the second outlet aperture 152 whose axis 262 makes the smaller elevation angle e2.

In the embodiment shown in FIGS. 9 and 10, the increase in flow rate Q2 of the second separated air stream 222 directed to the more distant part of the related length section of the pick channel 10 is achieved by increased number of the outlet apertures 152A, 152B whose axes 262 make the same elevation angle e2.

In a time interval of the weft thread pick carried out on the device for carrying out the method according to this invention, mutual relative movement of the direct pick channel 10 of the loom reed 1 may occur with respect to the ancillary jets 14 with the outlet apertures 15, 151, 152, 152A, 152B. This mutual relative movement can be brought about by the movement of either the pick channel 10 or of the ancillary jets 14, or both of these members, preferably at the beginning of the time interval of the weft insertion in to the shed, or at the end of this interval.

We claim:

1. A method of insertion of a weft thread into a shed of an air-operated jet loom of the type having a frame with a rotatably mounted loom reed having an axis of rotation, said loom reed having a plurality of gliders spaced horizontally apart from each other and connected perpendicularly to the axis of rotation of the loom reed, a portion of the gliders forming a horizontal direct pick channel having an open side and a bottom, the pick channel for being oriented in a pick position during a weft pick when the loom reed is rotated, a main pick jet located adjacent the open side of the pick channel at one end of the pick channel, a plurality of ancillary jets, each having an air stream aperature, the ancillary jets being horizontally spaced at regular intervals adjacent the pick channel open side on means for displacing the ancillary jets, the displacing means coupled with the motion of the pick channel in the loom reed and synchronized to displace the ancillary jets into a region defined by the pick channel such that a plane through the axis of rotation and each of the air stream aperatures also passes through the open side of the pick channel, the method comprising:

providing the weft thread at the end of the pick channel adjacent the main pick jet;

rotating the loom reed into the pick position;

blowing a main air stream through the main pick jet parallel to the loom reed axis of rotation in the direction of the weft thread insertion into the pick channel;

blowing a plurality of ancillary air streams through the plurality of air stream aperatures of the plurality of ancillary jets, each ancillary air stream directed along an air stream axis, each of which is oriented obliquely to the axis of rotation toward the bottom of the pick channel through the open side of the pick channel and in the direction of the weft thread insertion, such that a first vector component of the air stream axis is parallel to a force of gravity exerted on the weft thread, and a second vector component of the air stream axis is parallel to the axis of rotation of the loom reed, for moving the weft thread along the bottom of the pick channel while the loom reed is in the pick position.

2. A method according to claim 1, further comprising providing at least two separate air streams to form each ancillary air stream.

3. A method according to claim 2 further comprising providing a first air stream of each ancillary jet heaving a greater rate of flow than a second rate of flow of a second air stream of the ancillary jet.

4. A method according to claim 1, further comprising rotating the loom reed, and during at least a portion of the rotation, blowing the plurality of ancillary air streams directed along the plurality of air stream axes, each of which is oriented oblique to the axis of rotation toward the bottom of the pick channel through the open side of the pick channel and in the direction of the weft thread insertion.

5. A device for inserting a weft thread into a shed of an air-operated jet loom, the device comprising:

a frame, having a rotatably mounted loom reed having an axis of rotation;

a plurality of gliders horizontally spaced apart connected to the frame and oriented perpendicularly to the axis of rotation of the loom reed, a portion of the gliders forming a direct pick channel having an open side perpendicular to the direction of rotation of the loom reed, the pick channel for being oriented in a pick position during the rotating movement of the loom reed;

a main pick jet adjacent an open end of the pick channel when the channel is in said pick position;

a plurality of ancillary jets spaced at regular intervals along the pick channel;

displacing means for displacing the ancillary jets, movement of the displacing means coupled with movement of the pick channel and synchronized to displace the ancillary jets to the pick position adjacent the pick channel;

at least one outlet aperture in each of the plurality of ancillary jets for providing an air stream, the aperture having an air stream axis which is directed into the open end of the pick channel and obliquely in a direction of the weft thread insertion into the channel when the ancillary jets are displaced to the pick position, the air stream axis having an angle of elevation with respect to the weft thread such that one vector component of the air stream axis is directed on the weft thread in the direction of gravity.

6. A device according to claim 5, wherein the pick channel is shaped such that when the loom reed is in the pick position, a plane passing through the at least one outlet aperture and the axis of rotation of the loom reed, passes through the open side of the pick channel.

7. A device according to claim 6, wherein the at least one outlet apertures comprises at least two outlet apertures, a first air stream axis of one outlet aperture of each ancillary jet having a greater angle of elevation with respect to the weft thread than a second angle of elevation of a second air stream axis of a second outlet aperture.

8. A device according to claim 7, wherein the at least two outlet apertures each have a diameter, a first diameter of one outlet aperture being greater than a second diameter of a second outlet aperture.

9. A device according to claim 8, wherein the outlet aperture having the second diameter is the aperture having the first air stream axis.

* * * * *

UNITED STATES PATENT AND TRADEMARK OFFICE
CERTIFICATE OF CORRECTION

PATENT NO.: 5,641,002

DATED: June 24, 1997

INVENTOR(S): Petr Jirasko, Zdenek Volansky, Josef Dvorak, Zdenek Koloc

It is certified that error appears in the above-identified patent and that said Letters Patent is hereby corrected as shown below:

| Col. | Line | |
|---|---|---|
| 4 | 16 | reads "ancillary Set"<br>should read --ancillary jet-- |
| 10 | 5 | reads "jet heaving a"<br>should read --jet having a-- |

Signed and Sealed this

Twelfth Day of January, 1999

*Attest:*

*Attesting Officer*

*Acting Commissioner of Patents and Trademarks*